US006065545A

United States Patent [19]

Williams

[11] Patent Number: 6,065,545

[45] Date of Patent: May 23, 2000

[54] DUAL AGENT METHOD FOR EXTINGUISHING FIRE

[75] Inventor: Dwight P. Williams, Vidor, Tex.

[73] Assignee: Williams Fire & Hazard Control, Inc., Vidor, Tex.

[21] Appl. No.: 08/956,854

[22] Filed: Oct. 23, 1997

[51] Int. Cl.[7] ..... A62C 39/00

[52] U.S. Cl. ..... 169/47; 169/91

[58] Field of Search ..... 169/43, 44, 46, 169/47, 91

[56] References Cited

U.S. PATENT DOCUMENTS 3,630,412 12/1971 Capener et al. ..... 239/1 X 5,167,285 12/1992 Williams et al. ..... 239/1 X 5,393,437 2/1995 Bower ..... 252/7

*Primary Examiner*—Lesley D. Morris

*Attorney, Agent, or Firm*—Butler & Binion, L.L.P.; Sue Z. Shaper

[57] ABSTRACT

A method and composition for extinguishing fires using a plurality of firefighting agents wherein at least one of the agents has a distinctive visual coloration when thrown in a stream in the presence of the other agents; especially including for this purpose a dry chemical agent sufficiently colored that its presence can be detected when it is thrown together in a fluid stream with fluid and or foam.

13 Claims, 4 Drawing Sheets

(3 of 4 Drawing Sheet(s) Filed in Color)

DUAL AGENT METHOD FOR EXTINGUISHING FIRE

BACKGROUND OF THE INVENTION

1. Field of the Invention

The present invention is related to industrial fire fighting using thrown streams of firefighting agents, and more particularly, including the use of dry powder firefighting agents applied together with fluid mixtures including foam.

2. Background of the Invention

Commercial fighting of industrial fires, and particularly fires which include a replenishing source of flammable material (three dimensional or dynamic fires), may require the use of a plurality of fire fighting agents. These agents may be thrown or applied simultaneously, at least at times, either in adjacent streams or intermixed. In industrial fires generally, streams are thrown from nozzles at an approximate minimum of 95 gallons per minute (GPM) and frequently at much higher rates. However, in certain specific industrial applications, lower throw rates may be required: i.e. in air crash rescue fires the rate of throw is in the range of 35–60 GPM, while for offshore use throw rates of 60–120 GPM are employed. The present invention is applicable in all of these industrial situations.

One key example includes the use of dry chemicals in addition to liquids and liquid/foam mixtures. Dry chemicals are difficult to apply in a long distance stream. Further, dry chemicals have limited usefulness when applied alone primarily because they are not able to cool the fire and thus prevent reignition. Conversely, while liquids are able to control the heat and reduce the size of three dimensional fires, they are less effective than dry powder in controlling the chemical combustion that may sustain fires which have a continuing source of flammable material. Thus, U.S. Pat. No. 5,167,285 ('285) discloses a nozzle capable of simultaneously applying both liquid and dry powder.

The '285 nozzle, marketed under the tradename, "HydroChem", throws a stream of dry powder or chemical within a stream of liquid or foam by injecting the dry powder or chemical stream into the middle of the liquid or foam solution stream at the nozzle discharge port. The dry chemical stream is projected with and, to a certain extent, by the liquid/foam stream. When simultaneously dispensed by HydroChem nozzles, liquid agent streams are able to carry desired dry chemical streams to a fire apparently by entrapping, encapsulating, or entraining them within the fluid stream. Yet, the chemical performs like a "dry" chemical at the fire. Such transport with or in the liquid stream has enabled application of dry chemical agents from considerably greater distances than was previously possible.

Liquid/water mixtures are typically thrown continuously at fires using a high volume and velocity. When special agents such as dry chemicals are used, they are typically applied briefly and in small quantities at critical points during a firefighting episode. Because dry chemical agents are only available and used in small quantities relative to the volume of liquid and foam used, it would be highly desirable to be able to optimize the orchestration of their use. When the standard chemicals are applied simultaneously today, it is currently quite difficult to determine when and to what extent the special agents, such as dry chemicals, are present in the fluid stream and reaching the target. Neither the throw nor the footprint of the thrown special agent is visible using currently available formulations. Verification as to the presence of special agents in the thrown stream and the trajectory of these agents is of importance both to the individual operators of the fire extinguishing nozzles and to the director of the fire fighting team.

Liquid/foam mixtures currently used are either translucent, white, or gray. While dry powders having some coloration are commercially available for use in extinguishing fires, the coloration of such powders is currently insufficient for the dry chemical constituent to be readily visually apparent when thrown simultaneously with a water and/or foam stream. For example, Purple-K [PK] Dry Chemical Powder is known for use in extinguishing chemical fires and comprises potassium bicarbonate based dry chemical containing a purple pigment. Nevertheless, because of its relatively pale coloration, when Purple-K is thrown from a nozzle together with foam, the operator is unable to distinctly visually determine whether, where, or for how long, the powder is present in the stream.

When thrown with liquid or foam, currently available Purple-K powder is essentially undetectable within the fluid stream such that the only way that the presence of the powder in the stream is surmised is that after several seconds of application, some substance can be detected rather drifting in the air instead of more straightforwardly falling to the ground as fluid typically does. A fluid stream which contains a burst of dry powder usually ultimately attains a more foggy diffuse appearance. However, the fire director or pointer who coordinates the actions of the individual firefighters is unable to straightforwardly and immediately detect the presence of Purple-K in the liquid/foam stream, much less determine that the dry chemical is carrying to the target area. Further, the inability to immediately identify the presence of the powder potentially results in longer and injudicious use of the dry chemical agents such that this limited resource may be depleted too soon. A nozzle's supply of dry powder typically lasts only about 15 seconds. The coloration in available dry powders has historically been insufficient to provide a solution to these important problems.

This invention discloses the use of a violently or vividly colored special fire fighting agent, such as a dry chemical formulation which, contains sufficient pigment that a viewer of a thrown stream can readily visually determine the presence or absence of the agent, and its trajectory, when it is thrown simultaneously with other agents such as water or foam. Thus, an operator can appraise the extent to which the special agent is being acquired by the equipment and projected into the thrown stream. Fire pointers can assess the distance that the special agent is projected and the extent to which it is reaching the target area and, if desired, can optimize the orchestration of the use of bursts of dry chemical from the multitude of nozzles typically used in fighting an industrial fire. The invention applies equally to other agents or chemicals that might be included in or with a fire fighting stream, and might be thrown simultaneously with other fluids, and whose presence and extent of throw would be valuable to determine visually as the combined streams are applied. Dry chemical is the paradigmatic example.

The present invention discloses improved methods and compositions for use in the simultaneous application of two or more firefighting agents in a fluid stream wherein the addition of a visually distinctive coloration to an agent permits the operator of the equipment to readily visually appreciate the presence or absence of desired constituents in the stream. The method and compositions disclosed herein permit the judicious use of special fire extinguishing agents, including dry chemicals, and allows the firefighting team to coordinate the attack on the fire with an efficiency not previously possible. In the acute emergency of an industrial fire, it is crucial that the fire fighting team is easily aware of the presence and targeting of critical fire extinguishing agents. This invention discloses a simple, inexpensive real-time method and composition for acquiring this information.

SUMMARY OF THE INVENTION

The invention disclosed herein is both a method and a composition for extinguishing fires. The method comprises applying to a fire simultaneously two or more firefighting agents or compositions in a stream, preferably a fluid and a dry chemical, wherein at least one of the agents is sufficiently colored such that its presence can be easily visibly detected as a constituent of the fluid stream vis a vis another agent. In the preferred embodiment, the fluid includes a foaming composition.

"Agents for extinguishing fires" includes compounds now known or later developed which are useful in extinguishing fire. As used herein, "dry chemical" includes particulate matter, powders, or finely divided chemical compositions. "Fluid" comprises liquids including water and foam formulations.

Commercial firefighting personnel often describe extinguishing agents projected through the air at a fire as being "thrown." A "thrown stream" is utilized herein to refer to a path of fluid or fluids, including water, foam, dry chemicals, or other agents alone or in combination, projected through the air. "Simultaneous application" indicates the situation where certain fluids (such as water or foam and other agents, such as dry chemical agents) are combined into the same thrown stream such as by a nozzle that is capable of simultaneous throw of multiple agents. The degree to which the fluids intermix is sometimes unknown and a matter of speculation. "Applying to a fire a thrown stream including a plurality of agents" includes throwing fluids, such as water and/or foam and/or other agents, such as dry chemical, wherein the individual elements may mix, or may remain unmixed, or partially unmixed, in flight.

Industrial fires include fires of highly flammable substances including those which have a replenishing source of flammable material. Some examples of industrial fires include well blow outs, storage tank and tanker fires.

The invention discloses the use of a vivid coloration in one or more of a plurality of simultaneously applied fire extinguishing agents, the vivid color being sufficiently visually distinctive to permit visual identification of the presence of the individual agent when combined with other agents in a thrown fluid stream. Coloration, as used in this context herein, refers to colors of the electromagnetic spectrum, and, in addition, could include black and very dark gray. This is as opposed to variations of white or light gray that current fluid, foam, and/or dry powder exhibit today when thrown. Although the use of vivid colors as characterized by reflections of particular wavelengths of the electromagnetic spectrum is preferred, a black or very dark gray "coloration" could be formulated which would be arguably sufficiently distinctive to satisfy the aim of the present invention. Although black or very dark gray might not be favored because of the difficulties in visually distinguishing dark gray or black against the smoke of the fire itself, black or dark gray pigmentation, such as might be provided for one example by addition of carbon black, may have countervailing advantages such as being an inexpensive additive. Thus, the invention encompasses the use of pigmentation, including that which gives a black or dark gray coloration, which causes the presence of dry chemicals in a thrown stream to be visually distinctive.

"Visually distinctive" indicates that the colored agent has (or develops) sufficient coloration for it to be readily visually apparent to human bystanders, in particular nozzle operators and fire directors or pointers, when combined and thrown with other agents in a fluid stream.

BRIEF DESCRIPTION OF THE DRAWINGS

The file of this patent contains at least one drawing executed in color. Copies of this patent with color drawings will be provided by the Patent and Trademark Office upon request and payment of the necessary fee.

A better understanding of the present invention can be obtained from the detailed description of exemplary embodiments set forth below, to be considered in conjunction with the attached drawings, in which.

DESCRIPTION OF THE PREFERRED EMBODIMENTS

The invention discloses the addition of coloration to a particular agent included with a plurality of agents in a thrown stream of fire extinguishing agents, the coloration being sufficient to make the presence of the agent apparent in the presence of the other agents when thrown simultaneously. The invention is useful where quick, ready visual detection and confirmation of the presence and trajectory of the particular agent in the thrown stream is desired. The plurality of fire extinguishing agents can include various fluids, foam or dry powder. In a preferred embodiment, pigment is added to a fire extinguishing dry chemical powder such that the chemical takes on a coloration that is visually distinct when the dry powder is simultaneously thrown with fluid.

The invention encompasses the situation wherein the dry chemical or other special agent only takes on one visually distinctive coloration in flight when mixed with other agents in the thrown stream. Thus, the invention can include the use of water sensitive pigments that permit the dry chemical to assume the desired coloration after mixing with other agents in the thrown stream. In initial tests with a particular water sensitive pigment, it was found that the shelf life of the specially pigmented dry chemical powder was unsatisfactory. Therefore, in the preferred embodiment herein, a stable pigment is added to a dry powder in sufficient amounts to give it a vivid coloration not only as a dry powder but also when present together with a fluid/foam agent in a thrown stream.

Figure 1A:
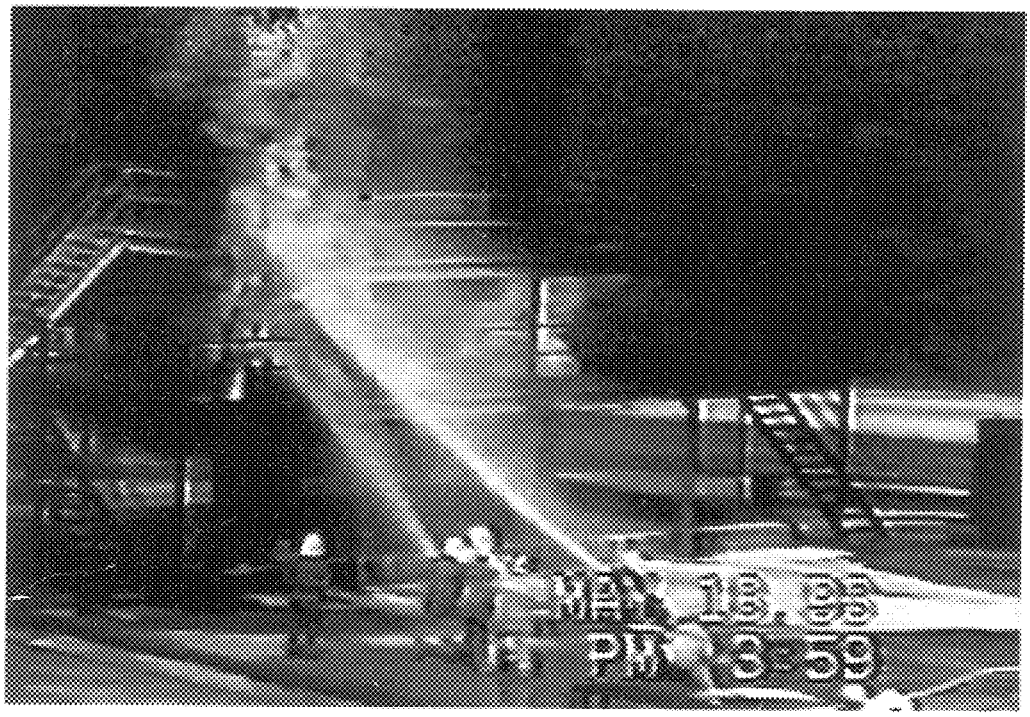
FIG. 1a (PRIOR ART)
FIG. 1*a* shows the extinguishment of an industrial fire using a thrown stream of 3M™ Light Water™ ATC™ Foam.
Figure 1B:
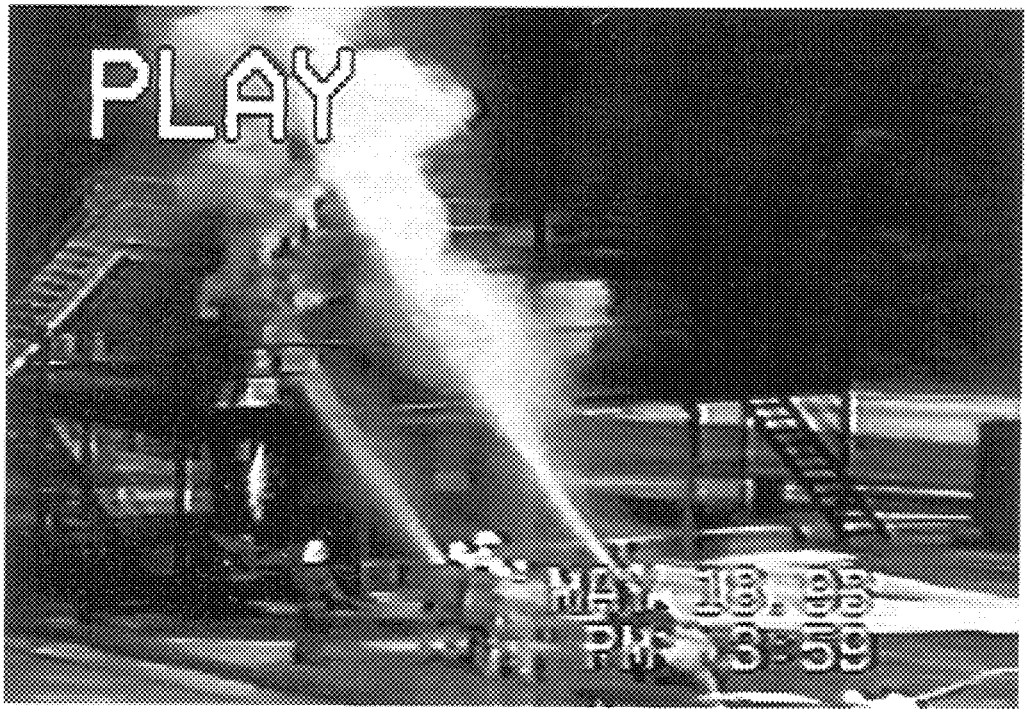
FIG. 1b (PRIOR ART)
FIG. 1*b* shows presently commercially available Purple-K Dry Chemical Powder injected into the thrown stream together with the 3M™ Light Water™ ATC™ Foam.

FIG. 1*a* is a photograph taken from a videotape of the extinguishment of an industrial fire. The figure shows two streams of 3M™ Light Water™ ATC™ Foam (3M, St. Paul, Minn.) thrown from two HydroChem™ nozzles (Williams Fire & Hazard Control, Inc., Mauriceville, Tex.). In FIG. 1*b* taken several frames later, the stream indicated by an arrow contains prior art Purple-K Dry Chemical Extinguishing Agent (Ansul Incorporated, Marinette, Wis.). The presence of the dry agent in the stream can be surmised only by virtue of the experienced eye detecting an increased fog drifting into the air. As shown in FIG. 1*b*, the presence of currently available dry powders, including Purple-K Dry Chemical, is not visually apparent in the thrown stream.

The present invention discloses the use of sufficient pigment for the presence of the powder in the thrown stream to be visible on the basis of its color, rather than any ancillary properties that may appear later such as increased fog drifting in the air. Such ancillary effects are not clearly and readily indicative of the real time presence of powder in the thrown stream as they appear at some time after the powder has been injected and continue for a period after the powder has been turned off.

Figure 2A:
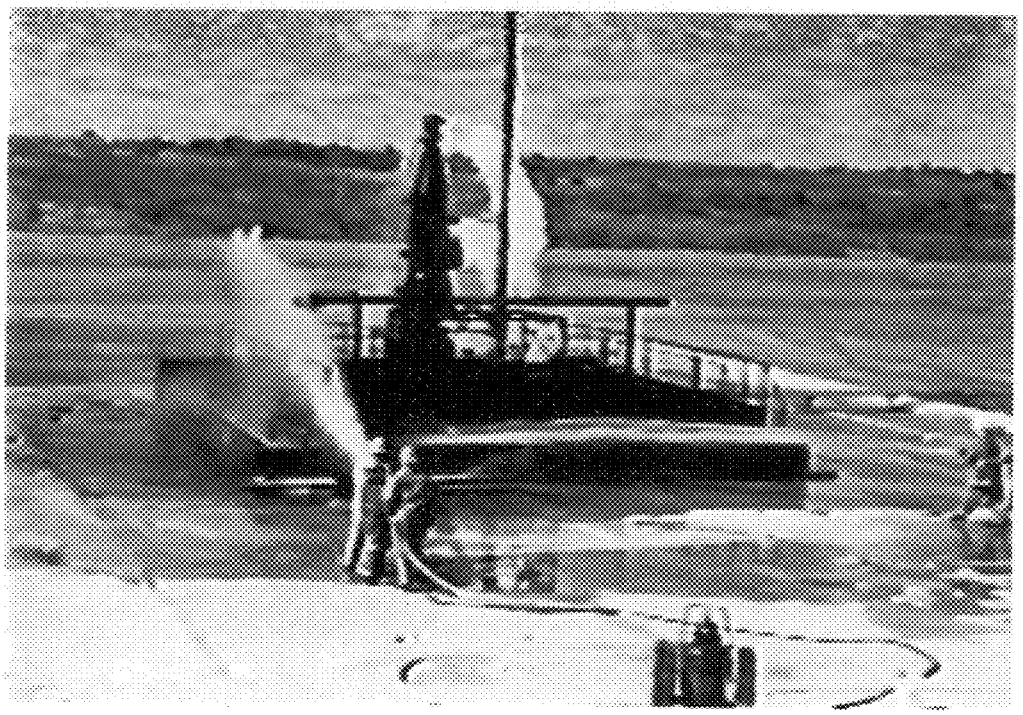
FIG. 2*a* shows the extinguishment of an industrial fire using 3M™ Light Water™ ATC™ Foam.
Figure 2B:
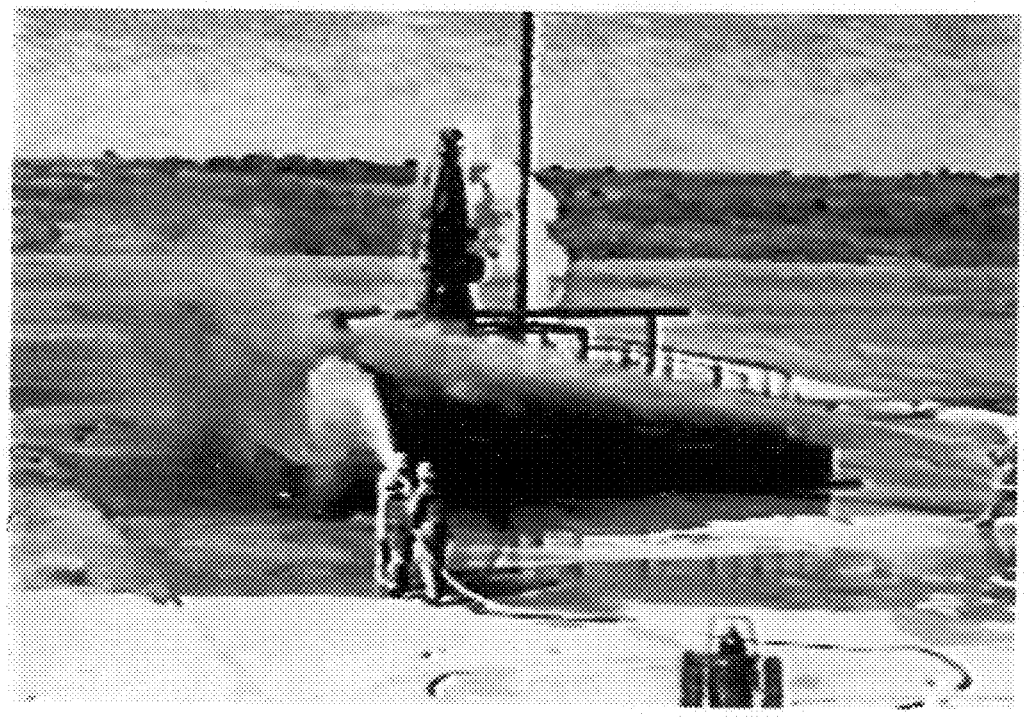
FIG. 2*b* shows dry powder sufficiently colored according to the present invention thrown simultaneously with the 3M™ Light Water™ ATC™ Foam.

In contrast, FIGS. 2*a* and 2*b* show the use of the method and composition of the subject invention. In FIG. 2*a* two streams of 3M™ Light Water™ ATC™ Foam are being thrown on the fire from two HydroChem™ nozzles. In FIG. 2*b*, dry powder colored according to the present invention is thrown from the nozzle on the right. By adding sufficient pigment to the Purple-K dry powder, the inclusion and trajectory of the now vividly colored agent when thrown together with other agents is obvious.

Figure 2C:
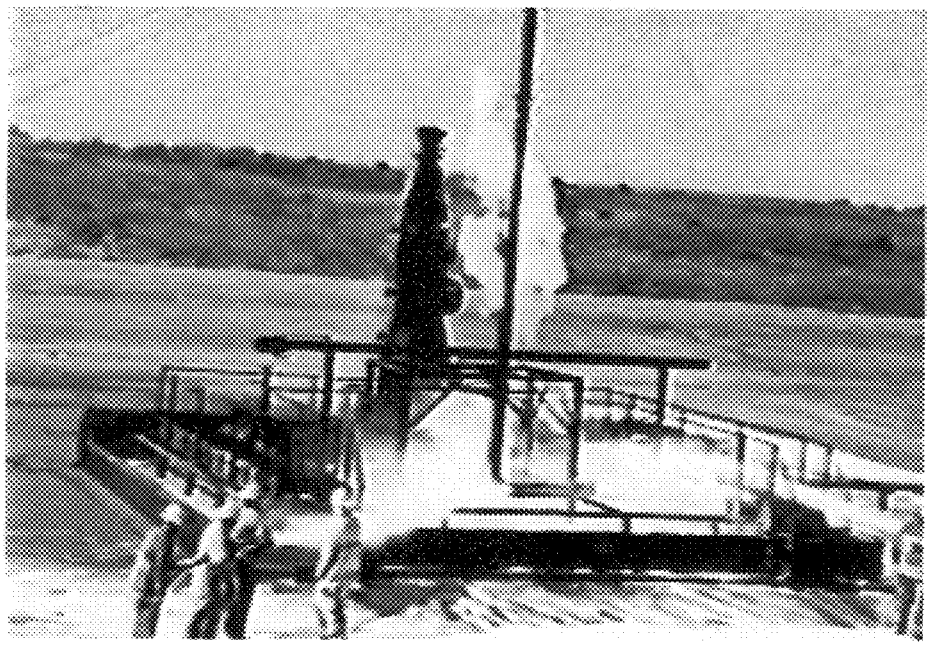
FIG. 2*c* illustrates the residual footprint on the ground of previously thrown dry powder colored according to the present invention.

Purple-K powder as is currently commercially available contains <0.005 Wt % purple pigment. The manufacturer of Purple-K powder. under direction from the inventor herein, produced a Purple-K powder with a sufficiently vivid purple coloration to function properly in accordance with the instant invention by the addition of substantial additional quantities of pigment. When sufficient additional pigment was added to Purple-K powder to allow it to perform the function of the present invention, the presence and trajectory of the dry chemical in the thrown stream was readily visually detected as shown in FIG. 2*b*. FIG. 2*c* shows that the use of vivid pigmentation in one of the agents included in the thrown stream forms a footprint of the specially colored agent on the ground such that the firefighting team can determine where the agent has been previously applied.

Figure 3:
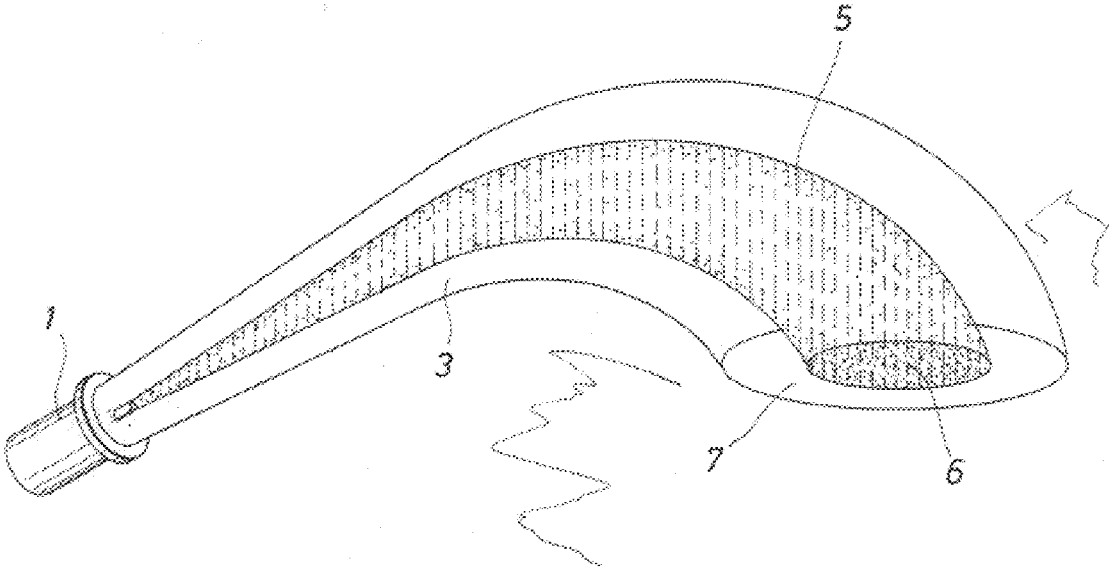
FIG. 3 is a schematic showing a thrown stream containing a plurality of fire extinguishing agents including one agent with coloration sufficient to distinguish its presence in the stream.
Figure 4A:
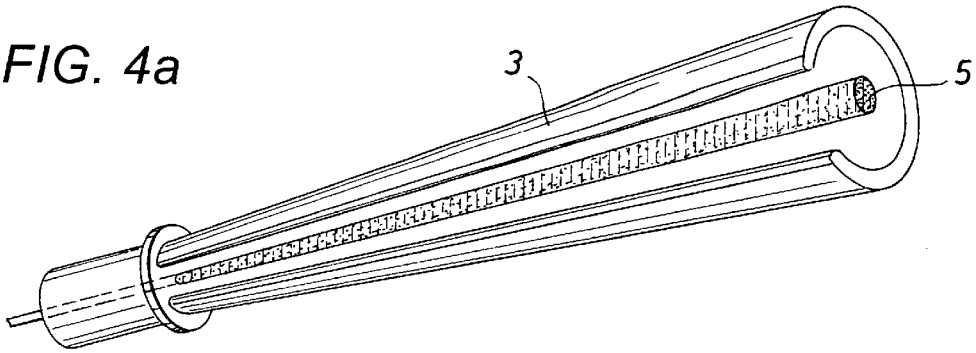
FIGS. 4*a, b*, and *c* show the inclusion of a specially colored agent in thrown streams of various types based on the type of nozzle used.
Figure 4B:
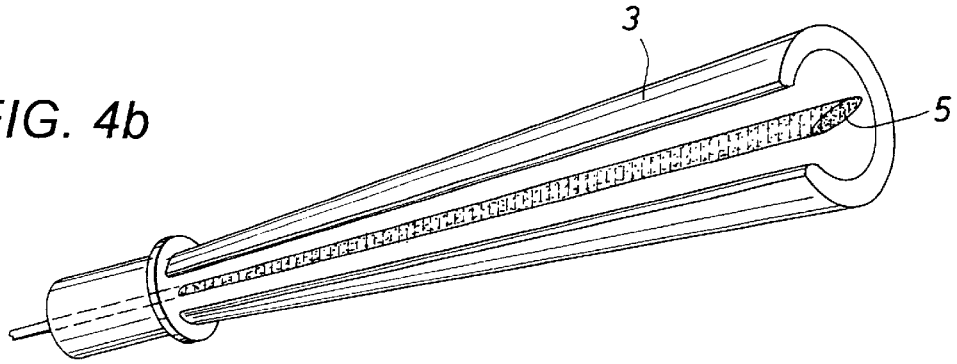
Figure 4C:
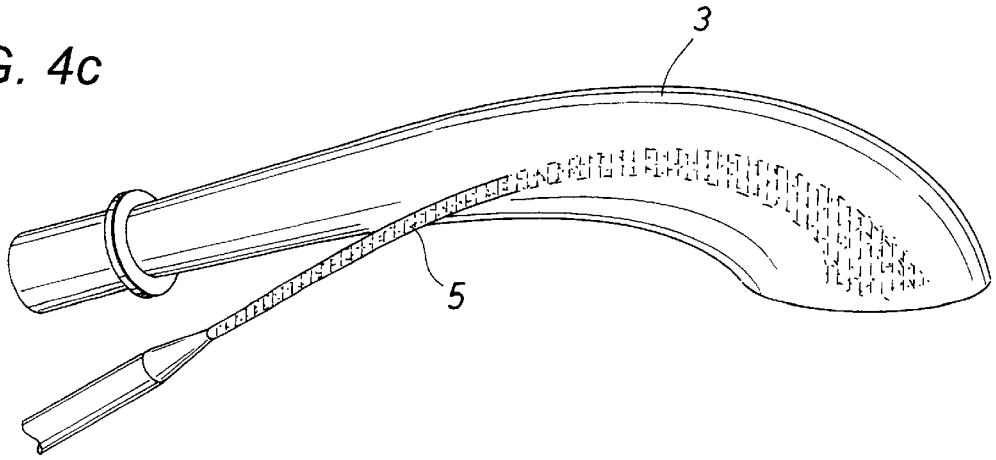

FIG. 3 is a schematic showing dry chemical powder 5 being thrown together with foam 3 from a HydroChem™ nozzle 1. The footprint of the foam 7 and the colored chemical 6 are apparent in the target area allowing the pointer to direct the team to reposition the nozzle. FIGS. 4*a, b*, and *c* show the inclusion of a specially colored agents in thrown streams of various types based on the type of nozzle used.

Using the method and composition of the present invention, firefighters can instantly visually determine whether the powder is being taken up and dispensed by the equipment as desired. The operator can also readily determine if flow of the powder is impeded or if the limited supply of dry powder has been exhausted. Both the operator and other members of the firefighting team will be able to quickly note the presence of powder in the stream of fluid and determine whether the trajectory and footprint of the dry chemical constituents are as predicted and intended in reaching critical areas within the combustion zone. These advantages will attach to the use of any visually distinctive individual agent used together with other fire extinguishing agents.

The foregoing disclosure and description of the invention are illustrative and explanatory thereof, and various changes in the size, shape, materials, as well as in the details of the illustrated system may be made without departing from the spirit of the invention. The invention is claimed using terminology that depends upon a historic presumption that recitation of a single element covers one or more, and recitation of two elements covers two or more, and the like.

What is claimed is:

1. An improved method for extinguishing industrial fires, comprising:

applying to a fire a thrown stream including a plurality of agents for extinguishing fire, including at least a liquid and a dry chemical, wherein at least one agent includes a vivid coloration element sufficient to exhibit a visually distinct presence, including against the fire, when thrown simultaneously with other agents in the stream.

2. The method of claim 1 wherein said dry chemical has an initially vivid coloration.

3. The method of claim 1 wherein said liquid is a foam.

4. The method of claim 1 wherein said liquid is water.

5. An improved method for extinguishing industrial fires, comprising: applying to a fire a thrown stream comprising a plurality of fire extinguishing agents, including at least a liquid and a dry chemical, and including vivid coloration means for visually identifying the presence of an agent within the thrown stream, including against the fire.

6. The method of claim 5 wherein said liquid is a foam.

7. The method of claim 5 wherein said liquid is water.

8. A dry chemical composition for extinguishing industrial fires in simultaneous application with at least one liquid agent, wherein the dry chemical contains a pigmentation element in sufficient quantity to enable the dry chemical to be clearly visible, including against a fire, when thrown simultaneously with the liquid.

9. The composition of claim 8 wherein said liquid is a foam.

10. The composition of claim 8 wherein said liquid is water.

11. A dry chemical composition for extinguishing industrial fires in simultaneous application with at least one liquid agent, comprising;

a dry chemical useful in extinguishing fire; and means for providing sufficient coloration to the dry chemical to enable ready visual detection of the chemical during simultaneous application in a thrown stream, including against the fire.

12. The composition of claim 11 wherein said liquid is from.

13. The composition of claim 11 wherein said liquid is a water.

* * * * *

UNITED STATES PATENT AND TRADEMARK OFFICE

CERTIFICATE OF CORRECTION

PATENT NO. : 6,065,545
DATED : May 23, 2000
INVENTOR(S) : Dwight P. Williams

It is certified that error appears in the above-identified patent and that said Letters Patent is hereby corrected as shown below:

Column 4, line 16,)
Page 5, line 14,) change "shows" to --is a color photograph taken from a videotape showing--.

Column 4, line 18,)
Page 5, line 17,) change "shows" to --is a color photo taken from the same videotape as Figure 1a several frames later when--.

(The first Examiner's amendment canceled "is" before --injected--. This would make sense if the first amendment to page 5, line 17 is retained. However, if the Examiner's second amendment applies, then "is" should remain.)

Column 4, line 21,)
Page 5, line 22,) change "shows" to --is a color photograph taken from a videotape showing--.

UNITED STATES PATENT AND TRADEMARK OFFICE

CERTIFICATE OF CORRECTION

PATENT NO. : 6,065,545
DATED : May 23, 2000
INVENTOR(S) : Dwight P. Williams

It is certified that error appears in the above-identified patent and that said Letters Patent is hereby corrected as shown below:

Column 4, line 23,)
Page 5, line 26,) after "shows" insert --the same fire as Figure 2a several frames later when--.

(If this amendment is made – to reverse the first amendment, then we should also make the following correction.)

Column 4, line 24,)
Page 5, line 27,) before "thrown" insert --is--.

Column 5, line 28,)
Page 7, line 7,) change "right" to --left--.

Column 5, line 34,)
Page 7, line 11,) change the period (second occurrence) to a comma.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*